United States Patent [19]

Rubin

[11] Patent Number: 4,904,966

[45] Date of Patent: Feb. 27, 1990

[54] SUSPENDED SUBSTRATE ELLIPTIC RAT-RACE COUPLER

[75] Inventor: David Rubin, San Diego, Calif.

[73] Assignee: The United States of America as represented by the Secretary of the Navy, Washington, D.C.

[21] Appl. No.: 100,515

[22] Filed: Sep. 24, 1987

[51] Int. Cl.[4] ..... H01P 5/22

[52] U.S. Cl. ..... 333/120; 333/26; 333/246

[58] Field of Search ..... 333/109, 116, 117, 120, 333/238, 246

[56] References Cited

U.S. PATENT DOCUMENTS

| | | | |
|---|---|---|---|
| 2,831,168 | 4/1958 | Smoll | 333/120 |
| 2,854,645 | 9/1958 | Arditi | 333/120 |
| 2,959,751 | 11/1960 | Budenbom | 333/120 |
| 3,158,824 | 11/1964 | Larsen et al. | 333/239 |
| 3,560,893 | 2/1971 | Wen | 333/24.1 |
| 3,621,478 | 11/1971 | Johnson | 333/116 |
| 4,303,900 | 12/1981 | Tourneur | 333/239 |
| 4,383,227 | 5/1983 | de Ronde | 333/246 X |

FOREIGN PATENT DOCUMENTS

| | | | |
|---|---|---|---|
| 210235 | 1/1956 | Australia | 333/120 |
| 594553 | 6/1976 | U.S.S.R. | 333/120 |
| 660129 | 11/1976 | U.S.S.R. | 333/120 |

OTHER PUBLICATIONS

Suspended Substrate Airstrip Cuts Microwave System Losses, Design Engineering (Gr. Brit.), Oct. 1976, p. 13.

*Primary Examiner*—Paul Gensler

*Attorney, Agent, or Firm*—Harvey Fendelman; Thomas G. Keough

[57] ABSTRACT

A suspended substrate rat-race coupler utilizes an elliptic configuration of the usual circular rat-race coupler on a circuit card positioned within below cut-off suspended substrate housing channels. The channels within the suspended substrate housing are positioned to receive the arms of the elliptical rat-race coupler. The longitudinal axis of two of the suspended substrate channels are offset with respect to each other to accommodate the rat-race arms and are positioned either on the same side of a primary suspended substrate channel or on opposite sides of the primary suspended substrate channel. Connections to the four ports of the rat-race can thus be made without disrupting the TEM propagation mode within the suspended substrate device.

13 Claims, 6 Drawing Sheets

SUSPENDED SUBSTRATE ELLIPTIC RAT-RACE COUPLER

STATEMENT OF GOVERNMENT INTEREST

The invention described herein may be manufactured and used by or for the Government of the U.S.A. for governmental purposes without the payment of any royalties thereon or therefor.

BACKGROUND OF THE INVENTION

The present invention relates generally to the field of microwave devices and, more particularly, to suspended substrate circuits. Still more particularly, the present invention relates to rat-race couplers.

The hybrid ring circuit, also known as the rat-race coupler, has been used for many years and is still an essential part of many complex microwave circuits such as mixers, phase shifters and power dividers. The rat-race coupler has three of the four transmission lines between ports equal to one-quarter wavelength and one line between ports equal to three-quarter wavelengths at the midband operating frequency of the device.

Referring to FIG. 1 a prior art rat-race coupler is schematically illustrated. As can be seen in FIG. 1, the rat-race coupler 12 is comprised of a circular ring 14 and four conductive arms or ports 16, 18, 20 and 22. The arms 16 and 18 are separated by an electrical length of $\lambda/4$ where $\lambda$ is the wavelength at the midband operating frequency of the device.

Similarly, ports 18, 20 and 22 are separated, respectively, by an electrical length of $\lambda/4$. Ports 16 and 22 are separated by an electrical length of $3\lambda/4$. It can readily be appreciated that an input on port 18 will result in an equal, in-phase division of the input signal on port 18 between ports 16 and 20. The port 22 is isolated from port 18 by reason of cancellation of the signals that would propagate around ring 14 in opposite directions. Particularly, any signal entering ring 14 via port 18 and propagating along the direction indicated by arrow 24 would propagate along an electrical length of $\lambda$ and any signal entering ring 14 via port 18 propagating in the direction indicated by arrow 26 along the ring would propagate through an electrical length of $\lambda/2$ to port 22. The propagation distance between port 18 and 22 via the direction of arrow 24 is therefore 180° out of phase with the signal propagating along ring 14 via the direction of arrow 26 and, therefore, cancellation of these two signals occurs (assuming equal loads on ports 16 and 20). Thus, by inputting a signal on input& port 18, and using appropriate loads on ports 16 and 20, the rat-race 12 acts as a splitter, with all the input power: absorbed by the two loads. The rat-race can also be used as a mixer if, for example, a local oscillator (L.0.) signal is injected on port 22. With an L.0. signal injected on port 22, equal, 180° phase shifted signals will appear on ports 16 and 20 and port 18 will be isolated. This is because the electrical propagation distance between ports 20 and 22 is $\lambda/4$ and the electrical propagation distance between ports 16 and 22 is $3\lambda/4$. Diodes at ports 16 and 20 appear as loads to both the L.O. and input radio frequency (R.F.) signals. Often the resulting intermediate frequency (I.F.) is removed at the symmetric position 27.

Cutoff frequency is defined as the lowest frequency which can propagate through a guide in a waveguide mode. A below cutoff frequency waveguide or below cutoff waveguide is a guide having dimensions which will not allow waveguide propagation modes at frequencies below the cutoff frequency. Below cutoff waveguide housings are always used with suspended substrate circuits and often with millimeter wave microstrip circuits. In these applications, rat-race couplers cannot be used without widening the enclosing channel and providing mode suppresion pins or other mode suppression devices. The provision of mode suppression devices usually requires drilling holes in the circuit substrates.

One method of coupling both R. F. signals and L. O. power into two diodes is through the use of a rat-race mixer as described above with respect to FIG. 1. The use of two diodes in a balanced arrangement helps to cancel noise due to L. 0. sidebands. The rat-race mixer involves the use of a circular ring of about one-half wavelength in diameter. The width of the ring, e.g. the width of ring 14 in FIG. 1, and the addition of the four conductor arms, e.g. 16, 18, 20 and 22 in FIG. 1, to the hybrid ring does not allow its use in a suspended substrate housing. This is because the suspended substrate housing must have a channel width less than one-half the wavelength of the highest propagating frequency in order to prevent propagation in the waveguide $TE_{10}$ mode.

FIG. 2 is a schematic illustration of a stripline channel 24 within a metallic housing and having a suspended substrate conductor 26 formed on a suspended substrate card (not shown) positioned within the stripline channel 24. In this prior art configuration TEM mode electromagnetic energy can propagate within the below cutoff waveguide 24. FIG. 3 is, likewise, a schematic illustration of a below cutoff waveguide channel 28 having a suspended substrate conductor 30 extending therethrough and also having a below cutoff waveguide channel 32 extending orthogonally from the primary channel 28. This configuration also permits the propagation of TEM mode energy within the below cutoff channels 28 and 32. FIG. 4 illustrates schematically two crossed below cutoff waveguides or channels 34 and 36 and having a suspended substrate rat-race coupler 38 positioned within the intersection of the crossed channels 34 and 36. It has been discovered that a suspended substrate transmission line within a housing having two crossed channels as shown in FIG. 4 will suffer extreme circuit loses. It is believed that the energy losses are due to higher order modes which occur when there are no sidewalls in each of the guides 34 and 36. The lack of one sidewall, as would be the case for the suspended substrate configuration of FIG. 3, does not cause any appreciable signal loss, however. The failure of the device constructed as shown in FIG. 4 is also believed to be attributable to the fact the sole sidewall current flow is necessary in order to support TEM propagation.

SUMMARY OF THE INVENTION

The present invention is a solution to the problem of forming a suspended substrate or microstrip circuit within a below cutoff waveguide housing and provides a simple means of allowing the use of a rat-race coupler within below cutoff channels. In accordance with the present invention no mode suppression pins are used and, therefore, the substrate need not be drilled. The suspended substrate rat-race coupler of the present invention is believed to be equal to or better in performance than microstrip circular rat-races tested in the same millimeter frequency range.

The present invention solves the suspended substrate rat-race problem by offsetting portions of one of the two crossed below cutoff waveguide channels to form what may be considered to be a primary below cutoff waveguide channel with two offset perpendicular channels. An elliptic suspended substrate rat-race coupler is positioned within the area formed by the juncture of the primary below cutoff waveguide channel and the offset below cutoff waveguide channels. A ring formed of a conductor having an appropriate width can thus be fit reasonably well into the juncture and extensions of the rat-race conductive arms or ports can be made into the below cutoff waveguide channels.

OBJECTS OF THE INVENTION

Accordingly, it is the primary object of the present invention to disclose a novel suspended substrate rat-race coupler.

It is also the object of the present invention to disclose the first suspended substrate rat-race coupler.

A still further object of the present invention is to disclose a rat-race coupler that has the capability of enabling its four ports to be connected within below cutoff waveguide channels without disrupting the TEM propagation mode.

These and other objects of the invention will become more readily apparent from the ensuing specification and claims when taken in conjunction with the attached drawings.

DESCRIPTION OF THE PREFERRED EMBODIMENT

Figure 1:
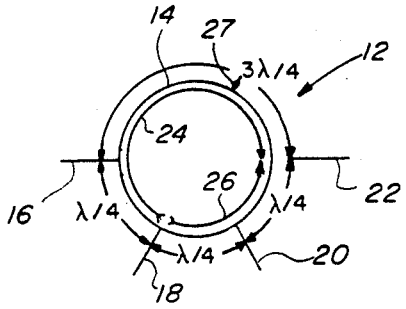
FIG. 1 (Prior Art)
FIG. 1 is a schematic illustration of a prior art rat-race coupler.
Figure 2:
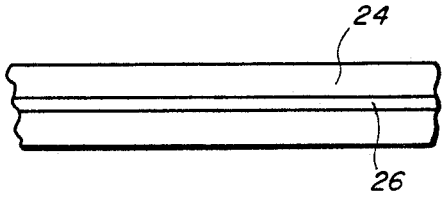
FIG. 2 (Prior Art)
FIG. 2 is a schematic illustration of a prior art suspended substrate line segment.
Figure 3:
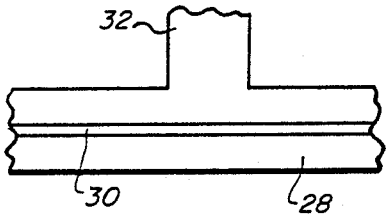
FIG. 3 (Prior Art)
FIG. 3 is a schematic illustration of a suspended substrate line within a channel having a T-channel connection.
Figure 4:
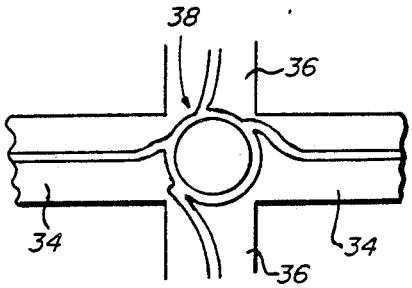
FIG. 4 is a schematic illustration of a conventional configuration rat-race coupler and illustrating how such a coupler could be introduced into two crossed below cutoff waveguide channels, albeit ineffectively.
Figure 5:
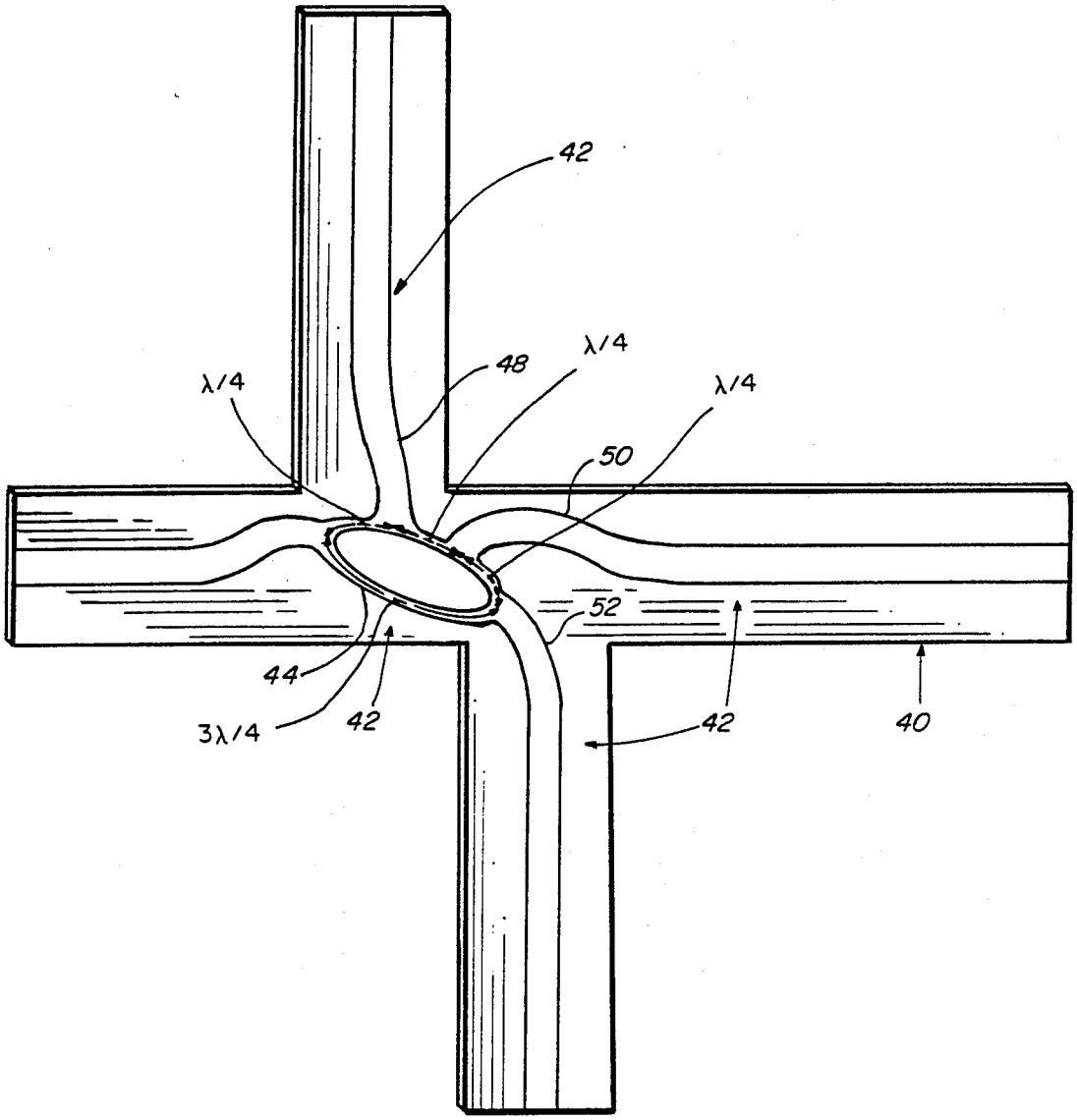
FIG. 5 is a perspective view of the elliptic rat-race coupler on a suspended substrate card in accordance with the present invention.

Referring to FIG. 5 the suspended substrate card portion of the elliptical rat-race coupler of the present invention is illustrated. Specifically, suspended substrate card 40 is the supporting structure for the suspended substrate circuit 42. Card 40 may be, for example, a dielectric material such as "Duroid" which is fiberglass impregnated "Teflon" or it may be, for further example, a flexible ceramic dielectric made from powdered ceramic material a is well known. The suspended substrate circuit 42 is preferably made of copper which is formed on the dielectric 40 by well known techniques. The circuit 42 is comprised of an elliptically shaped conductive portion 44 that constitutes the rat-race ring. Four ports or conductive arms 46, 48, 50 and 52 are electrically and physically connected to the elliptical ring 44 and are generally spaced as illustrated in FIG. 5. Specifically, the ports or arms 46 and 48 are spaced from each other along ring 44 by an electrical length of $\lambda/4$, where $\lambda$ is the wavelength at the midband operating frequency of the device. Likewise, the ports 48 and 50, and 50 and 52 are separated, respectively, by electrical lengths of $\lambda/4$. Ports 46 and 52 are separated along ring 44 by an electrical length of $3\lambda/4$. Because of the electrical length separation between the input/output ports 46, 48, 50 and 52, the device functions as a rat-race coupler as described above with respect to FIG. 1.

Figure 6:
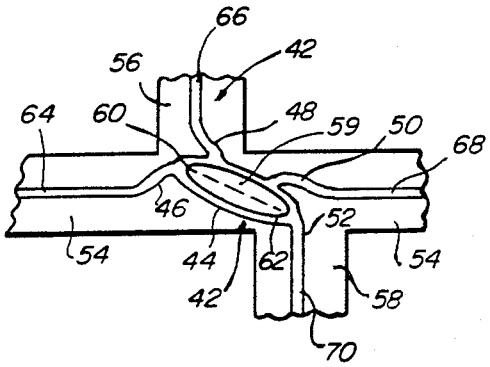
FIG. 6 is a schematic illustration of how the elliptic rat-race coupler of the present invention can be positioned within offset below cutoff waveguide channels.
Figure 6A:
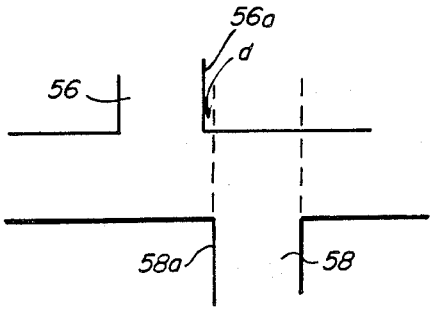
FIG. 6A is a top view of the offset below cutoff waveguide channels of the present invention illustrating the offset feature.

Referring now to FIG. 6 there is a schematic, top view illustration of how the rat-race circuit configuration 42 can be placed within below cutoff metallic housing channels to operate as a suspended substrate rat-race coupler. The circuit configuration 42 on card 40 is placed within a primary below cutoff waveguide channel 54. Displaced or offset below cutoff channels 56 and 58 extend or&orthogonally and in opposite directions as T's from the primary channel 54 as illustrated in FIG. 6. As can be seen in FIG. 6 the major axis of the elliptic ring 44 is positioned such that its distal ends 60 and 62 lie generally within the intersections, respectively, of the channel 54 with the channel 56 and of the channel 54 with the channel 58. By so orienting the major axis 59 of the elliptical ring 44, the conductive arms or ports of the rat-race circuit configuration can be positioned to be extended into the adjacent, respective below cutoff channels. Thus, port 46 can be extended via conductor 64 into the left hand portion of below cutoff channel 54, port 48 can be extended via conductor 66 into below cutoff channel 56, port 50 can be extended via conductor 68 into the right hand side of below cutoff channel 54 and, finally, port 52 can be extended via conductor 70 into below cutoff channel 58. Thus, two of the four ports of the rat-race configuration 42 can be extended outside of the main channel 54 within the other below cutoff waveguide channels 56 and 58. Applicant has discovered that the channel 58 should be offset with respect to the channel 56 such that no part of the volume within channel 58, if extended, would overlap any of the volume within channel 56 and such that the left sidewall **58*a* of channel 58 would not be collinear with the right sidewall 56*a* of the channel 56. There is, thus, at least a small separation "d" between the imaginary extension of left sidewall 58*a* and the right sidewall 56*a* of channels 58 and 56, respectively. This is illustrated in detail in FIG. 6*a***. By way of example the offset "d" may be 0.010".

Figure 10:
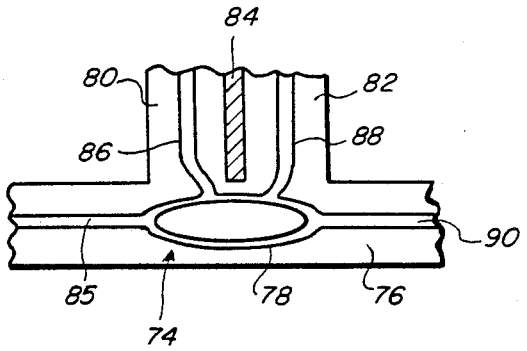
FIG. 10 is a schematic illustration of an alternate version of the present invention wherein the below cutoff waveguide channels extending from the primary channel are extended on the same side rather than the opposite side of the below cutoff waveguide channel.

In an alternate embodiment of the present invention depicted in FIG. 10, an elliptical rat-race suspended substrate coupler 74 can be formed on a suspended substrate card (not shown) and positioned within a primary below cutoff waveguide channel 76 with the primary axis of the ellipse of elliptic conductor 78 being collinear with the longitudinal axis of the below waveguide channel 76. Further, a first below cutoff waveguide channel 80 extends from primary waveguide channel 76 and a second below waveguide channel 82 extends from primary below waveguide channel 76, both below waveguide channels 80 and 82 extending from primary waveguide 76 on the same side and being separated by metallic wall 84. The four ports or conducting arms 85, 86, 88 and 90 of the rat-race 74 are thus extended into, respectively, the left side, as illustrated in FIG. 10, of primary below cutoff waveguide channel 76, below cutoff waveguide channel 80, below cutoff waveguide channel 82 and the right side, as illustrated in FIG. 10, of primary below cutoff waveguide channel 76.

Figure 7:
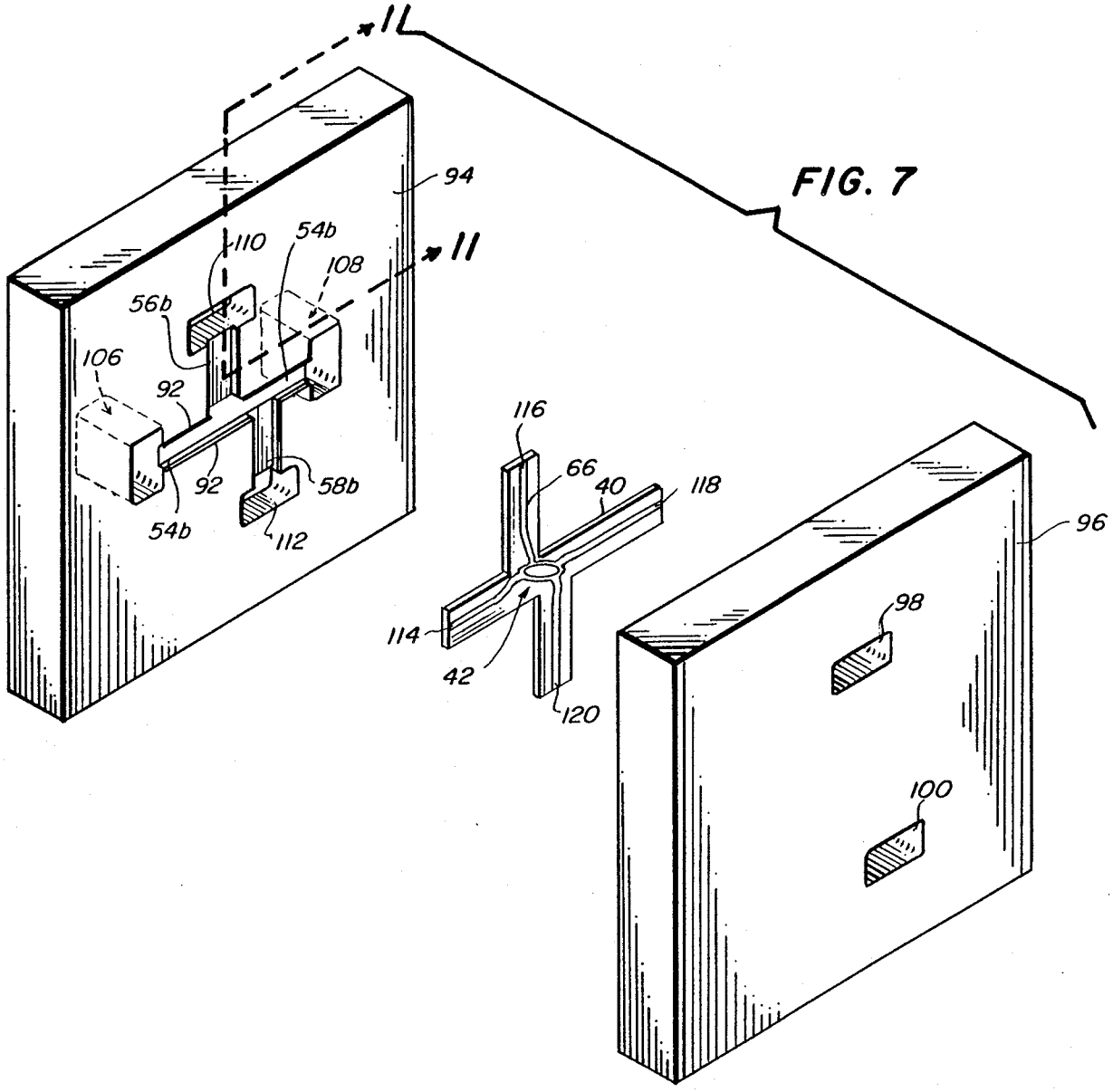
FIG. 7 is an exploded view of the suspended substrate elliptic rat-race coupler of the present invention.
Figure 8:
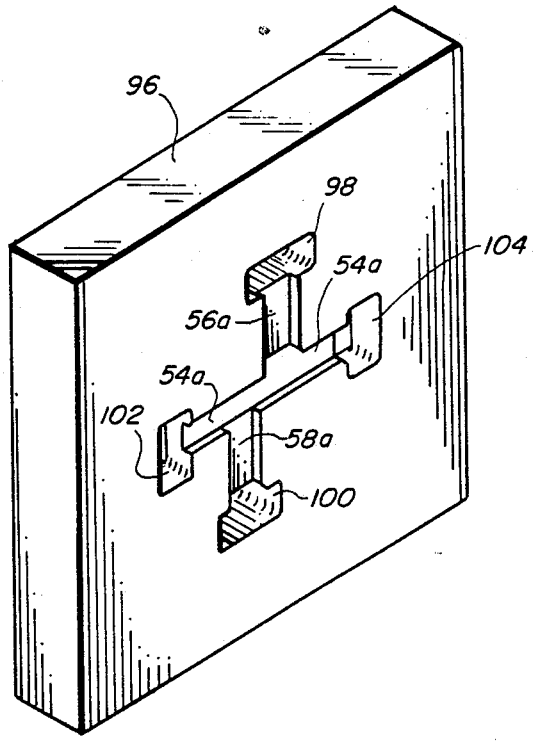
FIG. 8 is an isometric view of the top portion of the device illustrated in FIG. 7 rotated from right to left 180°.

FIG. 7 illustrates a three dimensional exploded isometric view of the suspended substrate rat-race coupler of the present invention illustrated in FIG. 6. In FIG. 7, the suspended substrate card 40 is shown as being positioned on a small ledge 92 formed within the inner surface of the lower half 94 of the metallic waveguide housing within which the below cutoff waveguide channels are formed. The top half 96 of the housing includes a first input/output port 98 and a second input-/output port 100. The inner surface of top half 96 of the metallic housing also includes a first back short cavity 102 and a second back short cavity 104 as is illustrated in FIG. 8. Similarly, bottom half 94 of the metallic housing includes a first input/output port 106 and a second input/output port 108 which extends completely through the housing portion 94. Bottom half 94 of the metallic housing also includes a first back short cavity 110 and a second back short cavity 12. When the suspended substrate card 40 is in position, sandwiched between the top and bottom halves 94 and 96, respectively, of the metallic housing, the ends 114, 116, 118 and 120 of the circuit configuration 42 extend into and lie over the back short cavities 102, 110, 104 and 112, respectively.

The below cutoff waveguides channels 54, 56 and 58 illustrated schematically in FIG. 6 are thus formed by the channel halves **54*a*, 56*a*, 58*a* in metallic housing top half portion 96 and channel halves 54*b*, 56*b* and 58*b* formed metallic housing bottom half portion 94. It can thus be appreciated that R.F. energy can be input into or output from the rat-race suspended substrate coupler of the present invention via any of the input/output ports 98, 100, 106 or 108**.

Figure 11:
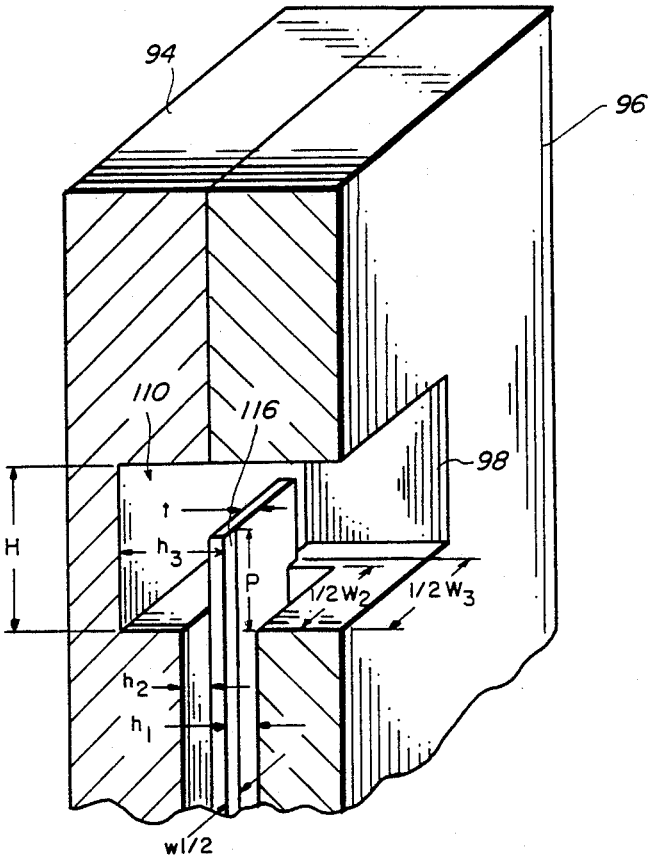
FIG. 11 is a partial cross half-section taken through lines 11—11 of FIG. 7 and showing, by way of example, suitable dimensions for the present invention.

The half section depicted in FIG. 11 illustrates, by way of example, suitable dimensions for the present invention for a suspended substrate rat-race coupler for operation in the 26.5 to 40 GHz frequency band for a suspended substrate coupler formed on a flexible ceramic substrate. The dimensions t, p, $w_1$, $h_t$, $w_2$, $w_3$, H, $h_1$, $h_2$, and $h_3$ illustrated in FIG. 11 may be, by way of example, as follows:

Waveguide Band (GHz)—26–40
t—(Substrate Thickness)—0.005"
p—(Probe Length)—0.080"
$w_1$—(Line Width)—0.028"
$h_t$—(Channel Height)—0.057"
$w_2$—(Channel Width)—0.116"
$w_3$—(Substrate Width)—0.124"
H—(Waveguide Height)—0.124"
$h_1$ & $h_2$—(Substrate to Upper & Lower Walls)—0.026"
$h_3$—(Backshort Distance)—0.100"

Figure 9:
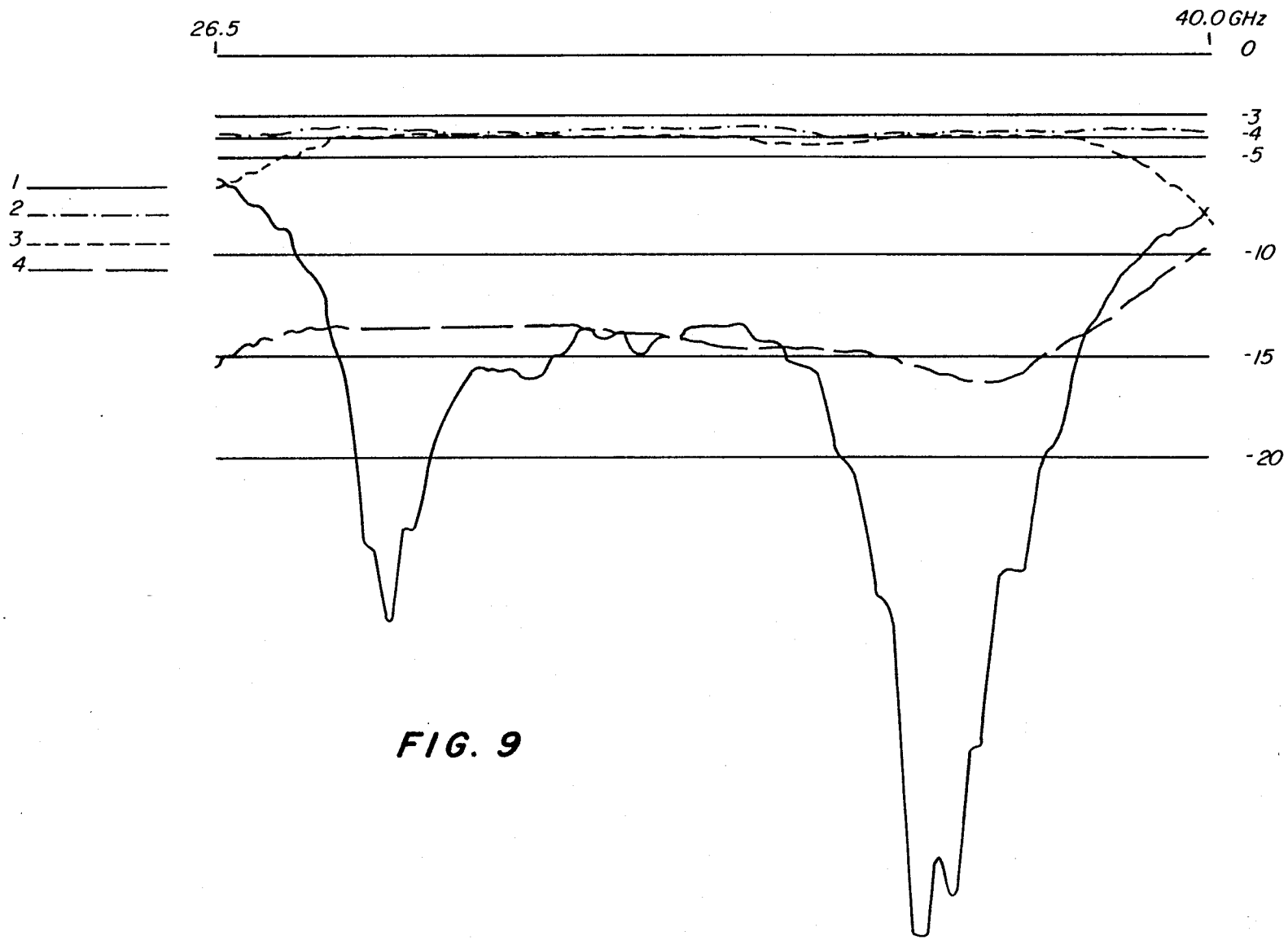
FIG. 9 is a graph of the frequency response characteristics of the device of the present invention illustrated in FIG. 7.

Finally, FIG. 9 illustrates, by way of example, the measured frequency response of the suspended substrate rat-race coupler of the present invention for a device operating in the frequency band between 26.5 and 40 GHz. In the graph of FIG. 9 curve 1 indicates the return loss of the input signal, curves 2 and 3 indicate the signals propagating on equally divided coupled ports of the rat-race coupler of the present invention and curve 4 illustrates the signal attenuation on the isolated port. Transition losses are indicated.

Obviously, many modifications and variations of the present invention are possible in the light of the above teachings. It is therefore to be understood that within the scope of the appended claims the invention may be practiced otherwise than as specifically described.

I claim:

1. A suspended substrate rat-race coupler comprising:

a metallic housing having first, second and third stripline channels for propagating electromagnetic energy, each of said first, second and third channels having a longitudinal axis, said longitudinal axis of said second channel being offset from the longitudinal axis of said third channel, said second and third channels intersecting with and extending from said first channel and said first channel having first and second ends;

a suspended substrate circuit card positioned within said first, second, and third channels, having an electrically conductive pattern thereon, said electrically conductive pattern comprising:

an elliptic conductor;

first, second, third and fourth conductor arms, each being electrically connected to said elliptic conductor and disposed radially around said conductor, said first conductor arm extending into said first channel first end, said second conductor arm extending into said second channel, said third conductor arm extending into said third channel and said fourth conductor arm extending into said first channel second end.

2. The coupler of claim 1 wherein:

said electrically conductive pattern is a rat-race configuration.

3. The coupler of claim 1 wherein:

the ellipse of said elliptical conductor has a major axis having first and second distal ends and wherein said first distal end is positioned adjacent said intersection of said first and second channels and wherein said second distal end is positioned adjacent said intersection of said first and third channels.

4. The coupler of claim 3 wherein:

said longitudinal axis of said first channel is aligned obliquely to said major axis.

5. The coupler of claim 1 wherein:

said second and third channel are on opposite sides of said first channel.

6. The coupler of claim 1 wherein:

said second and third channels are on the same side of the said first channel.

7. The coupler of claim 6 wherein:

the ellipse of said elliptical conductor has a major axis that is collinear with said longitudinal axis of said first channel.

8. The coupler of claim 1 wherein:

said first and second conductor arms, said second and third conductor arms and said third and fourth conductor arms are separated, respectively, along said elliptic conductor by an electrical length of $\lambda/4$ and where said first and fourth conductor arms are separated along said elliptic conductor by an electrical length of $3\lambda/4$, where $\lambda$ is the wavelength at the midband operating frequency of said coupler.

9. A suspended substrate rate-race coupler comprising:

a metallic housing having first, second and third channels for propagating electromagnetic energy in the TEM mode;

a suspended substrate circuit card positioned within said first, second, and third channels, having an electrically conductive pattern formed thereon, said pattern comprising a rat-race coupler, said conductive pattern coacting with said metallic housing to propagate electromagnetic energy in a predominant TEM mode down said first, second, and third channels;

said second and third channels each having near walls positioned relatively close to each other and each having far walls positioned relatively further away from each other, said second and third channel near walls each having a longitudinal axis, said longitudinal axes of said second and third walls being non-collinear and each of said longitudinal axes, whether or not extended, lying outside of the other channel.

10. The coupler of claim 9 wherein:

said conductive pattern comprises:

an elliptical conductor; and first, second, third and fourth conductor arms extending from said elliptical conductor.

11. The coupler of claim 10 wherein:

said second and third channels are on opposite sides of said first channel.

12. The coupler of claim 9 wherein:

said second and third channels are on opposite sides of said first channel.

13. The coupler of claim 9 wherein:

said second and third channels are on the same side of said first channel.

* * * * *